US006762162B1

(12) United States Patent
Valpey, III et al.

(10) Patent No.: US 6,762,162 B1
(45) Date of Patent: Jul. 13, 2004

(54) DISINFECTING CATIONIC POLYMER CLEANER COMPRISING AN ACRYLATE CATIONIC POLYMER

(75) Inventors: Richard S. Valpey, III, Lindenhurst, IL (US); Brandon R. Thalmann, La Porte, IN (US)

(73) Assignee: S. C. Johnson & Son, Inc., Racine, WI (US)

( * ) Notice: Subject to any disclaimer, the term of this patent is extended or adjusted under 35 U.S.C. 154(b) by 1 day.

(21) Appl. No.: 10/464,202

(22) Filed: Jun. 18, 2003

(51) Int. Cl.[7] ..... C11D 3/48; C11D 3/37

(52) U.S. Cl. ..... 510/214; 510/382; 510/384; 510/391; 510/398

(58) Field of Search ..... 510/214, 382, 510/384, 391, 398

(56) References Cited

U.S. PATENT DOCUMENTS

| | | | | |
|---|---|---|---|---|
| 3,976,501 | A | | 8/1976 | Blue |
| 4,443,363 | A | | 4/1984 | Klinger et al. |
| 4,477,375 | A | | 10/1984 | Grollier |
| 4,596,668 | A | | 6/1986 | Berbeco |
| 4,624,890 | A | | 11/1986 | Lloyd et al. |
| 4,880,558 | A | | 11/1989 | Jost et al. |
| 5,000,867 | A | | 3/1991 | Heinhuis-Walther et al. |
| 5,348,678 | A | | 9/1994 | Hodam, Jr. et al. |
| 5,604,189 | A | * | 2/1997 | Zhang et al. ..... 510/112 |
| 5,811,386 | A | | 9/1998 | Mueller et al. |
| 5,837,665 | A | | 11/1998 | Young |
| 5,965,088 | A | | 10/1999 | Lever et al. |
| 5,965,514 | A | | 10/1999 | Wierenga et al. |
| 6,071,866 | A | | 6/2000 | Fujiwara et al. |
| 6,159,924 | A | | 12/2000 | Weller et al. |
| 6,251,849 | B1 | | 6/2001 | Jeschke et al. |
| 6,268,327 | B1 | | 7/2001 | Lu et al. |
| 6,325,862 | B1 | | 12/2001 | Otsuki |

FOREIGN PATENT DOCUMENTS

| | | |
|---|---|---|
| DE | 2913049 A1 | 10/1980 |
| EP | 0 017 149 B1 | 2/1980 |
| EP | 467 472 A3 | 1/1992 |
| EP | 467 472 A2 | 1/1992 |

* cited by examiner

*Primary Examiner*—Charles Boyer

(57) ABSTRACT

Acidic hard surface cleaners are disclosed having a disinfectant which is a quaternary ammonium biocide and/or a substituted guanidine biocide such as a biguanide biocide. There is also a cationic polymer and a surfactant which does not have an anionic moiety. Water is also included at the time of use.

13 Claims, No Drawings

DISINFECTING CATIONIC POLYMER CLEANER COMPRISING AN ACRYLATE CATIONIC POLYMER

CROSS-REFERENCE TO RELATED APPLICATIONS

Not applicable

STATEMENT REGARDING FEDERALLY SPONSORED RESEARCH/DEVELOPMENT

Not applicable

FIELD OF THE INVENTION

The present invention relates to cleaners, particularly hard surface cleaners in which the cleaner imparts desired cleaning and surface appearance characteristics to the surface being cleaned while also disinfecting the surface being cleaned.

BACKGROUND OF THE INVENTION

There are a variety of known hard surface cleaning materials, including a number which are designed for cleaning and otherwise improving the appearance of floors and the like. See e.g. U.S. Pat. Nos. 3,976,501, 4,443,363, 4,596,668, 4,880,558, 5,000,867, 5,348,678, 5,811,386, 5,965,514, 6,159,924 and 6,325,862.

There have also been suggestions to include in a hard surface cleaner a quaternary ammonium compound as a germicidal active to disinfect a hard surface while it is being cleaned. See e.g. U.S. Pat. No. 6,268,327. This patent specifically suggests the use of an alkyl dimethyl benzyl ammonium chloride compound, such as BTC® 2125M, as a preferred quaternary ammonium germicide.

There has also be some use of biguanide (a/k/a diguanide) antimicrobial compounds in cleaners (e.g. especially skin cleaners) where the cleaner kills bacteria on the surface it is applied to. See U.S. Pat. No. 6,071,866.

Also, it has been suggested to incorporate biguanides and/or ammonium compounds (such as benzylalkyldimethylammonium chloride) in cleaners to act as preservatives while the cleaner is stored. See e.g. European patent application 017,149.

It has been further proposed to included substituted guanidine anti-microbial agents in a sanitizing composition. See U.S. Pat. No. 5,000,867.

Some cationic polymers have also been proposed for incorporation in certain cleaning materials to improve cleaning effectiveness or impart desired attributes to the surface after being cleaned. See e.g. EP 017,149 and 6,251,849.

However, there is a continuing need to develop improved cleaning materials, particularly for floor care cleaners that require a disinfecting capability (e.g. for hospital maintenance). In this regard, formulation components that act as effective cleaners or disinfectants for floors may not be optimal for imparting desired residual characteristics to the surface (e.g. imparting shine; avoiding slippery conditions; avoiding unduly long periods for drying).

In some cases the art has split the cleaning/disinfecting and the surface treating functions into two separate products. It is much more desirable to have a single step ("one-step") product that addresses the needed cleaning and disinfecting characteristics in a very efficient manner, yet also leaves desired residual properties.

Further complicating matters is that if one tries to simply increase the level of biocide incorporated in the formulation, the cost of the final product can be adversely impacted and the nature of the product can be altered in a way that causes the product to have poor suspension characteristics. It would be particularly desirable to use relatively low levels of a biocide, yet find a way to improve biocidal activity of the existing amount of biocide.

Thus, a need still exists to develop improved hard surface cleaners that also are designed to disinfect floors.

SUMMARY OF THE INVENTION

It has been discovered that the combination of cationic polymers, preferably cationic emulsion polymers, even more preferably cationic emulsion polymers having an acrylate monomer moiety, will cause synergistic biocidal activity with quaternary ammonium biocides and/or substituted guanidine biocides, in hard surface cleaner formulations.

In one aspect the invention provides a cleaner having a pH of 7.0 or lower (preferably between 4.0 and 6.0). The cleaner includes (i) a biocidal disinfecting material selected from the group consisting of quaternary ammonium biocides and substituted guanidine biocides, (ii) a cationic polymer, (iii) a surfactant selected from the group consisting of nonionic and cationic surfactants, and (iv) water.

Where the biocidal disinfecting material is a quaternary ammonium biocide, particularly useful quaternary ammonium germicides are those described in U.S. Pat. No. 6,268,327. In this regard, quaternary ammonium biocides of this type have the nitrogen linked to four carbon-containing R groups and there is a salt-forming anionic member, such as a halide. The most preferred R groups are between 6 to 26 carbon atoms.

Particularly preferred exemplary quaternary ammonium salts which are quaternary ammonium biocides are alkyl ammonium halides such as cetyl trimethyl ammonium bromide, alkyl aryl ammonium halides such as alkyl dimethyl benzyl ammonium chloride, N-alkyl pyridinium halides such as N-cetyl pyridinium bromide, and the like. Other suitable types of quaternary ammonium salts may include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other quaternary ammonium germicides are lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, and chlorinated dodecylbenzyltrimethyl ammonium chloride.

Examples of such preferred quaternary ammonium biocides are the BTC®, BARDAC®, and HYAMINE® biocides, such as BTC 2125M. BTC biocides are available from Stepan Co., and BARDAC and HYAMINE biocides are available from Lonza, Inc.

We prefer to use these biocides at under 1 percent to minimize cost and reduce disruption to the other characteristics of the mixture. However, the concentration could be more, albeit the concentration could be as little as 0.001 percent by weight. Most preferably we prefer weight percentages between 0.10 percent and 0.5 percent when this type of germicide is used.

The biocidal disinfecting material can alternatively be a substituted guanidine anti-microbial agent. See generally U.S. Pat. No. 5,000,867 for compounds of this general class.

In the most preferred form the biocidal substituted guanidine compound may be a biguanide. In general, such a biguanide compound may contain one or more monomers of:

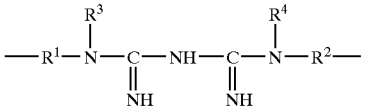

In this formula $R^1$ through $R^4$ can be a variety of different moieties. Examples are aryl, alkyl, hydrogen or just bonds. Some of these are where $R^1$ and $R^2$ are alkylene chains optionally substituted by a phenyl radical (which itself optionally may be substituted by alkyl or alkoxy groups), and the other R groups may be hydrogen, $C_{1-12}$ alkyl or $C_{7-12}$ aralkyl. It is also possible that some of the R groups may be linked to form cyclic portions. The substituted guanidine (e.g. biguanide) anti-microbial agents also include the acid addition salt variants.

A particularly preferred bisbiguanide is 1,6-bis-(p-chlorophenyldiguanido)hexane in the form of the hydrochloride, acetate or gluconate, this compound is available from Avecia of Manchester, England.

The preferred concentration of the substituted guanide disinfectant in the cleaner is preferably that described above with respect to the quaternary ammonium disinfectants.

In preferred forms the water is at least 50 percent of the weight of the cleaner at the time of use. Of course, the formulation may be prepared as a concentrate, with the consumer diluting the concentrate in a bucket immediately prior to use.

In another preferred form the cleaner has an organic solvent which provides a wider range of cleaning capability to the cleaner (e.g. with respect to hydrophobic soils on the floor). Preferred amounts of organic solvent are between 0.05 percent and 10 of the cleaner, most preferably between 1 and 5 percent of the cleaner, with the solvent being a mixture of such solvents. A particularly preferred mixture of organic solvents is a mixture of two glycol ethers such as a mixture of diethylene glycol butyl ether (a/k/a butyl carbitol) and ethylene glycol hexyl ether (a/k/a hexyl cellosolve).

Further, a third solvent (such as propylene glycol or ethylene glycol) can be used with this preferred mixture. In an especially preferred form at least one of the three solvents has a boiling point of over 100° C. so as to provide the final product with optimal visual characteristics on a floor or the like.

Where the product is intended as a floor cleaner, it is desirable to include a wax in the cleaner so as to leave a shine on the floor after the cleaning and disinfecting step has been completed. Preferred waxes are paraffin wax, carnuba wax and synthetic wax, or mixtures thereof. A particularly preferred wax is a nonionic paraffin sold under the name Michem Lube 743 supplied by Michaelman of Cincinnati, Ohio.

Another especially important attribute of the cleaner is the cationic polymer. It is preferably present at between 1 and 20 percent concentration, most preferably at about 6 to 8 weight percent of the cleaner at the time of use. Again, where the cleaner is supplied as a concentrate the percentages can be higher, subject to the dilution prior to use.

A wide variety of cationic polymers should be suitable for use with the present invention. This will normally be achieved by a polymer being functionalized with some nitrogen-containing moiety capable of becoming cationic.

The most preferred polymers are emulsion polymers such as those made from acrylate monomers at least in part. Examples of such polymers are Suretec NS 54, a cationic acrylate emulsion polymer supplied by Suretec, Inc. formed from a monomer mix of styrene, methyl methacrylate, dimethyl amino ethyl methacrylate, and butyl acrylate. Other example polymers are the Neocryl A series polymers from Avecia, Inc.

Preferred aspects of the cationic emulsion polymer are that there be some polymeric portion (e.g. acrylic, urethane, etc.) which is functionalized by a cationic group such as a nitrogen group. Particularly preferred polymers exceed 2000 in molecular weight. This is important because the polymer will then provide sufficient bulk to provide durability under floor use conditions.

The presence of a cationic portion is important. Without wishing to be bound by theory, we believe that polymers used to impart shine contain residual impurities that tend to quench the specific biocidal materials even if the impurities are present in only trace amounts.

As noted above, it is desirable that the cleaner, at the time of use, and preferably during storage, have a pH that is not basic. Moreover, the desirable properties of the cleaner are greatly enhanced if the pH is between 4 and 6. While an even lower pH is possible, that might begin to have adverse effects on the floor or other surface being treated, and/or place undesirable limitations on skin contact.

While a wide variety of nonionic and cationic surfactants are possible to include, we prefer to include only nonionic surfactants given that cationic surfactants sometimes have foaming and other characteristics making them somewhat more difficult to use for standard floor care purposes. The most preferred surfactants are the alkyl polyglucosides. Other nonionic surfactants should prove suitable, such as ethoxylates, pluronics, fatty ester nonionic surfactants, and ethanolamine nonionic surfactants.

Examples of preferred cationic surfactants, when they are used, are the Ammonyx surfactants available from Stepan of Northfield, Ill. However, many other cationic surfactants are believed suitable for use with the present invention.

The formulation optionally may also include a variety of other ingredients conventional in floor care (e.g. a chelating agent such as EDTA, a plasticizer such as tributoxy ethyl phosphate, and fragrance). Further, other ingredients that are not disruptive to the function of the product may also be included. In this regard, in some embodiments we also prefer to include a fluorosurfactant for additional visual effects.

In another aspect the invention provides a method of killing bacteria on a floor surface. One exposes the floor surface to a floor cleaner of the above type, thereby killing the bacteria.

It should be appreciated that the above compositions achieve surprising disinfectant results using relatively small amounts of disinfectant. Most importantly this is achieved without significantly adversely impacting on other desired attributes of the product (e.g. cleaning, shelf stability, residual shine, durability).

Because the amount of disinfectant can be reduced for a given level of disinfecting capability, the cost of the product can be reduced. Further, the product is suitable for long-term inventory and consumer storage.

The foregoing and other advantages of the present invention will appear from the following description. In the description reference is made to preferred embodiments of the invention. These embodiments do not represent the full scope of the invention. Rather, reference should therefore be made to the claims herein for interpreting the full scope of the invention.

DETAILED DESCRIPTION OF THE INVENTION

One embodiment ("Formula A") of the cleaner of the present invention is a disinfecting floor cleaner having the following formula:

| Weight Percent | Common Name | Chemical Name | Type | Function within the formulation |
|---|---|---|---|---|
| 87.09 | deionized water | water | water | water |
| 1.77 | Michem Lube 743 | non-ionic paraffin wax | builder | conditioner |
| 0.20 | EDTA | tetrasodium salt of ethylene diamine tetramine | base | cleaner |
| 7.00 | Suretec NS 54 | cationic emulsion polymer | builder | conditioner |
| 0.08 | acetic acid | acetic acid | organic acid | adjusts the pH |
| 1.00 | alkyl polyglucos ide | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 0.20 | KF 140 | tributoxy ethyl phosphate | solvent | cleaner |
| 0.40 | Zestofresh 133.285 F | mixture of fragrance oils | fragrance | fragrance |

A second embodiment ("Formula B") of the cleaner of the present invention is a disinfecting floor cleaner having the following formula:

| Weight Percent | Common Name | Chemical Name | Type | Function within the formulation |
|---|---|---|---|---|
| 87.09 | deionized water | water | water | water |
| 1.77 | Michem Lube 743 | non-ionic paraffin wax | builder | conditioner |
| 0.20 | EDTA | tetrasodium salt of ethylene diamine tetramine | base | cleaner |
| 7.00 | Neocryl A-410 | cationic emulsion polymer | builder | conditioner |
| 0.08 | acetic acid | acetic acid | organic acid | adjusts the pH |
| 1.00 | alkyl polyglucos ide | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |

-continued

| Weight Percent | Common Name | Chemical Name | Type | Function within the formulation |
|---|---|---|---|---|
| 0.20 | KP 140 | tributoxy ethyl phosphate | solvent | cleaner |
| 0.40 | Zestofresh 133.285 F | mixture of fragrance oils | fragrance | fragrance |

A third embodiment ("Formula C") of the cleaner of the present invention is a disinfecting floor cleaner having the following formula:

| Weight Percent | Common Name | Chemical Name | Type | Function within the formulation |
|---|---|---|---|---|
| 86.97 | deionized water | water | water | water |
| 1.77 | Michem Lube 743 | non-ionic paraffin wax | builder | conditioner |
| 0.20 | EDTA | tetrasodium salt of ethylene diamine tetramine | base | cleaner |
| 7.00 | Neocryl A-410 | cationic emulsion polymer | builder | conditioner |
| 0.40 | acetic acid | acetic acid | organic acid | adjust the pH |
| 1.00 | alkyl polyglucos ide | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 0.40 | Zestofresh 133.285 F | mixture of fragrance oils | fragrance | fragrance |

A fourth embodiment ("Formula D") of the cleaner of the present invention is a disinfecting floor cleaner having the following formula:

| Weight Percent | Common Name | Chemical Name | Type | Function within the formulation |
|---|---|---|---|---|
| 87.17 | deionized water | water | water | water |
| 1.77 | Michem Lube 743 | non-ionic paraffin wax | builder | conditioner |
| 7.00 | Neocryl A-410 | cationic emulsion polymer | builder | conditioner |
| 0.40 | acetic acid | acetic acid | organic acid | adjusts the pH |
| 1.00 | alkyl polyglucos ide | alkyl polyglycoside | surfactant | cleaner |
| 0.28 | BTC 2125 M | alkyl dimethyl benzyl ammonium chloride | biocide | disinfectant |

-continued

| Weight Percent | Common Name | Chemical Name | Type | Function within the formulation |
|---|---|---|---|---|
| 1.75 | butyl carbitol | butyl cellosolve | solvent | cleaner |
| 0.23 | hexyl cellosolve | hexyl cellosolve | solvent | cleaner |
| 0.40 | Zestofresh 133.285 F | mixture of fragrance oils | fragrance | fragrance |

A fifth embodiment ("Formula E") of the cleaner of the present invention is a disinfecting floor cleaner having the following formula:

| Weight Percent | Common Name | Chemical Name | Type | Function within the formulation |
|---|---|---|---|---|
| 86.97 | deionized water | water | water | water |
| 1.77 | Michem Lube 743 | non-ionic paraffin wax | builder | conditioner |
| 7.00 | Neocryl A-410 | cationic emulsion polymer | builder | conditioner |
| 0.40 | stearic acid | stearic acid | organic acid | adjusts the pH |
| 1.00 | alkyl polyglucos ide | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 0.40 | Zestofresh 133.285 F | mixture of fragrance oils | fragrance | fragrance |
| 0.20 | KP 140 | tributoxy ethyl phosphate | solvent | cleaner |

A sixth embodiment ("Formula F") of the cleaner of the present invention is a disinfecting floor cleaner having the following formula:

| Weight Percent | Common Name | Chemical Name | Type | Function within the formulation |
|---|---|---|---|---|
| 86.97 | deionized water | water | water | water |
| 1.77 | Michem Lube 743 | non-ionic paraffin wax | builder | conditioner |
| 7.00 | Neocryl A-410 | cationic emulsion polymer | builder | conditioner |
| 0.20 | EDTA sodium salt | tetrasodium salt of ethylene diamine tetramine | base | cleaner |
| 0.40 | stearic acid | stearic acid | organic acid | adjusts the pH |
| 1.00 | alkyl polyglucos ide | alkyl polyglycoside | surfactant | cleaner |

-continued

| Weight Percent | Common Name | Chemical Name | Type | Function within the formulation |
|---|---|---|---|---|
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 0.40 | Zestofresh 133.285 F | mixture of fragrance oils | fragrance | fragrance |

A seventh embodiment ("Formula G") of the cleaner of the present invention is a disinfecting floor cleaner having the following formula:

| Weight Percent | Common Name | Chemical Name | Type | Function within the formulation |
|---|---|---|---|---|
| 87.17 | deionized water | water | water | water |
| 1.77 | Michem Lube 743 | non-ionic paraffin wax | builder | conditioner |
| 7.00 | Neocryl A-410 | cationic emulsion polymer | builder | conditioner |
| 0.40 | stearic acid | stearic acid | organic acid | adjusts the pH |
| 1.00 | alkyl polyglucos ide | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 0.40 | Zestofresh 133.285 F | mixture of fragrance oils | fragrance | fragrance |

An eighth embodiment ("Formula H") of the cleaner of the present invention is a disinfecting floor cleaner having the following formula:

| Weight Percent | Common Name | Chemical Name | Type | Function within the formulation |
|---|---|---|---|---|
| 86.77 | deionized water | water | water | water |
| 1.77 | Michem Lube 743 | non-ionic paraffin wax | builder | conditioner |
| 7.00 | Neocryl A-410 | cationic emulsion polymer | builder | conditioner |
| 0.40 | stearic acid | stearic acid | organic acid | adjusts the pH |
| 1.00 | alkyl polyglucos ide | alkyl polyglycoside | surfactant | cleaner |
| 0.28 | BTC 2125 M | alkyl dimethyl benzyl ammonium chloride | biocide | disinfectant |

-continued

| Weight Percent | Common Name | Chemical Name | Type | Function within the formulation |
|---|---|---|---|---|
| 1.75 | butyl carbitol | butyl cellosolve | solvent | cleaner |
| 0.23 | hexyl cellosolve | hexyl cellosolve | solvent | cleaner |
| 0.40 | Zestofresh 133.285 F | mixture of fragrance oils | fragrance | fragrance |
| 0.20 | EDTA sodium salt | tetrasodium salt of ethylene diamine tetramine | base | cleaner |
| 0.20 | KP 140 | tributoxy ethyl phosphate | solvent | cleaner |

A ninth embodiment ("Formula I") of the cleaner of the present invention is a disinfecting floor cleaner having the following formula:

| Weight Percent | Common Name | Chemical Name | Type | Function within the formulation |
|---|---|---|---|---|
| 86.09 | deionized water | water | water | water |
| 1.77 | Michem Lube 743 | non-ionic paraffin wax | builder | conditioner |
| 0.20 | EDTA | tetrasodium salt of ethylene diamine tetramine | base | cleaner |
| 7.00 | Neocryl A-410 | cationic emulsion polymer | builder | conditioner |
| 0.08 | acetic acid | acetic acid | organic acid | adjusts the pH |
| 1.00 | alkyl polyglucoside | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 1.0 | propylene glycol | propylene glycol | solvent | cleaner |
| 0.20 | KP 140 | tributoxy ethyl phosphate | solvent | cleaner |
| 0.40 | Zestofresh 133.285 F | mixture of fragrance oils | fragrance | fragrance |

A tenth embodiment ("Formula J") of the cleaner of the present invention is a disinfecting floor cleaner having the following formula:

| Weight Percent | Common Name | Chemical Name | Type | Function within the formulation |
|---|---|---|---|---|
| 86.09 | deionized water | water | water | water |
| 1.77 | Michem Lube 743 | non-ionic paraffin wax | builder | conditioner |

-continued

| Weight Percent | Common Name | Chemical Name | Type | Function within the formulation |
|---|---|---|---|---|
| 0.20 | EDTA | tetrasodium salt of ethylene diamine tetramine | base | cleaner |
| 7.00 | Neocryl A-410 | cationic emulsion polymer | builder | conditioner |
| 0.08 | acetic acid | acetic acid | organic acid | adjusts the pH |
| 1.00 | alkyl polyglucoside | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 1.0 | ethylene glycol | ethylene glycol | solvent | cleaner |
| 0.20 | KP 140 | tributoxy ethyl phosphate | solvent | cleaner |
| 0.40 | Zestofresh 133.285 F | mixture of fragrance oils | fragrance | fragrance |

An eleventh embodiment ("Formula K") of the cleaner of the present invention is a disinfecting floor cleaner having the following formula:

| Weight Percent | Common Name | Chemical Name | Type | Function within the formulation |
|---|---|---|---|---|
| 86.99 | deionized water | water | water | water |
| 1.77 | Michem Lube 743 | non-ionic paraffin wax | builder | conditioner |
| 0.20 | EDTA | tetrasodium salt of ethylene diamine tetramine | base | cleaner |
| 7.00 | Neocryl A-410 | cationic emulsion polymer | builder | conditioner |
| 0.08 | acetic acid | acetic acid | organic acid | adjusts the pH |
| 1.00 | alkyl polyglucoside | alkyl polyglycoside | surfactant | cleaner |
| 0.28 | BTC 2125 M | alkyl dimethyl benzyl ammonium chloride | biocide | disinfectant |
| 1.75 | butyl carbitol | butyl cellosolve | solvent | cleaner |
| 0.23 | hexyl cellosolve | hexyl cellosolve | solvent | cleaner |
| 0.20 | KP 140 | tributoxy ethyl phosphate | solvent | cleaner |
| 0.40 | Zestofresh 133.285 F | mixture of fragrance oils | fragrance | fragrance |
| 0.10 | fluororad | fluorocarbon | surfactant | cleaner |

For comparison purposes we also created two other analogous formulations where the formula contained a non-cationic emulsion polymer in place of the cationic acrylic emulsion polymer. Formula L has the following formula:

| Weight Percent | Common Name | Chemical Name | Type | Function within the formulation |
|---|---|---|---|---|
| 89.11 | deionized water | water | water | water |
| 1.77 | wax emulsion | synthetic wax | builder | conditioner |
| 0.20 | EDTA sodium salt | tetrasodium salt of ethylene diamine tetramine | base | cleaner |
| 6.64 | NT-2624 | non-cationic emulsion polymer | builder | conditioner |
| 1.00 | alkyl polyglucos ide | alkyl polyglucoside | surfactant | cleaner |
| 0.28 | BTC 2125 M | alkyl dimethyl benzyl ammonium chloride | biocide | disinfectant |
| 0.57 | butyl carbitol | butyl cellosolve | solvent | cleaner |
| 0.23 | hexyl cellosolve | hexyl cellosolve | solvent | cleaner |
| 0.20 | KP 140 | tributoxy ethyl phosphate | solvent | cleaner |

Formula M had the following formula:

| Weight Percent | Common Name | Chemical Name | Type | Function within the formulation |
|---|---|---|---|---|
| 88.555 | deionized water | water | water | water |
| 1.77 | wax emulsion | synthetic wax | builder | conditioner |
| 0.20 | EDTA sodium salt | tetrasodium salt of ethylene diamine tetramine | base | cleaner |
| 6.64 | NT-2624 | cationic emulsion polymer | builder | conditioner |
| 1.00 | alkyl polyglucos ide | alkyl polyglycoside | surfactant | cleaner |
| 0.84 | BTC 2125 M | alkyl dimethyl benzyl ammonium chloride | biocide | disinfectant |
| 0.57 | butyl carbitol | butyl cellosolve | solvent | cleaner |
| 0.23 | hexyl cellosolve | hexyl cellosolve | solvent | cleaner |
| 0.20 | KP 140 | tributoxy ethyl phosphate | solvent | cleaner |

To test the disinfectant properties of the formulas A and B versus L and M listed above, we generally followed the protocol for disinfectants specified in European Standard EN 1040:1997 "Bactericidal activity of chemical disinfectants", with both gram positive and gram negative bacteria.

With respect to each of four typical contaminating bacteria we tested the number of colony forming units at time zero, and the number of colony forming units at the end of the test after a standard time period. The log reduction of colony forming units per ml was as follows for each of the tests:

| Formulation | Log Reduction |
|---|---|
| Formulation A | |
| *Staphlococcus aureus* | >6.19 |
| *Pseudonomas aeruginosa* | >6.53 |
| *Escherichia coli* | >6.14 |
| *Enterococcus hirae* | >6.15 |
| Formulation B | |
| *Staphlococcus aureus* | >6.36 |
| *Pseudonomas aeruginosa* | >6.27 |
| *Escherichia coli* | >6.14 |
| *Enterococcus hirae* | >6.15 |
| Formulation L | |
| *Staphlococcus aureus* | <4.65 |
| *Pseudonomas aeruginosa* | >6.14 |
| *Escherichia coli* | <4.64 |
| *Enterococcus hirae* | <4.43 |
| Formulation M | |
| *Staphlococcus aureus* | <4.65 |
| *Pseudonomas aeruginosa* | <5.55 |
| *Escherichia coli* | <4.64 |
| *Enterococcus hirae* | <4.43 |

As can be seen, formulations of the present invention were surprisingly more effective across a broad range of challenge bacteria. Yet, these results were achieved even though other desired characteristics of the cleaner were retained (particularly with respect to suspension characteristics).

The preceding description is merely of preferred embodiments of the invention. One skilled in the art will readily apprehend alternative embodiments that nevertheless fall within the scope and breadth of the invention. Thus, the claims should be looked to in order to understand the full scope of the invention.

INDUSTRIAL APPLICABILITY

Disclosed are hard surface cleaners with improved disinfectant capability.

What is claimed is:

1. A cleaner having a pH of 7.0 or lower, the cleaner comprising:

a biocidal disinfecting material selected from the group consisting of quaternary ammonium biocides and substituted guanidine biocides;

a cationic polymer formed from at least one acrylate monomer;

a surfactant selected from the group consisting of nonionic and cationic surfactants; and optionally water.

2. The cleaner of claim 1, wherein water is present in the cleaner and the pH of the cleaner is between 4.0 and 6.0.

3. The cleaner of claim 1, wherein the biocidal disinfecting material is a quaternary ammonium biocide.

4. The cleaner of claim 1, wherein the biocidal disinfecting material is a biguanide.

5. The cleaner of claim 4, wherein the biocidal disinfecting material is a bisbiguanide.

6. The cleaner of claim 2, wherein the water is at least 50 percent of the weight of the cleaner.

7. The cleaner of claim 1, further comprising an organic solvent.

8. The cleaner of claim 7, wherein the organic solvent is a glycol ether having a boiling point of over 100° C. at standard atmospheric pressure.

9. The cleaner of claim 1, wherein the cleaner is a floor cleaner and the cleaner further comprises a wax selected from the group consisting of paraffin wax, carnuba wax and synthetic wax.

10. The cleaner of claim 1, wherein the cleaner also includes an organic acid.

11. The cleaner of claim 1, wherein the cleaner includes a nonionic surfactant.

12. The cleaner of claim 1, wherein the cleaner further comprises a fluorosurfactant.

13. A method of killing a bacteria on a floor surface, comprising exposing the surface to a floor cleaner, wherein the floor cleaner has a pH of 6.0 or lower and comprises:

a biocidal disinfecting material selected from the group consisting of quaternary ammonium biocides and substituted guanidine biocides;

a cationic polymer formed from at least one acrylate monomer;

a surfactant selected from the group consisting of nonionic and cationic surfactants; and water.

* * * * *